US009583850B1

(12) United States Patent
Diokno et al.

(10) Patent No.: US 9,583,850 B1
(45) Date of Patent: Feb. 28, 2017

(54) CONNECTOR MODULE WITH A RESEAT ACTUATOR

(71) Applicant: Lenovo Enterprise Solutions (Singapore) Pte. Ltd., Singapore (SG)

(72) Inventors: Robert Diokno, Raleigh, NC (US); Michael D. French, Raleigh, NC (US); Timothy R. Tennant, Durham, NC (US); Paul D. Kangas, Raleigh, NC (US)

(73) Assignee: Lenovo Enterprise Solutions (Singappore) Pte. Ltd., Singapore (SG)

( * ) Notice: Subject to any disclaimer, the term of this patent is extended or adjusted under 35 U.S.C. 154(b) by 0 days.

(21) Appl. No.: 14/987,994

(22) Filed: Jan. 5, 2016

(51) Int. Cl.
*H01R 12/70* (2011.01)
*H01R 13/641* (2006.01)

(52) U.S. Cl.
CPC ..... *H01R 12/7058* (2013.01); *H01R 13/641* (2013.01)

(58) Field of Classification Search
CPC ... H01R 12/7058; H01R 12/72; H01R 12/721; H01R 12/737; H01R 13/641; H01R 13/62988; H01R 13/6335; H01R 13/62938; H01R 13/62933
USPC ..... 439/64, 188, 157, 160, 325, 345, 372, 439/636, 637
See application file for complete search history.

(56) References Cited

U.S. PATENT DOCUMENTS 3,899,234 A * 8/1975 Yeager ..... H01R 12/89 439/260
3,903,385 A * 9/1975 Moyer ..... H01R 12/721 200/243
3,920,302 A * 11/1975 Cutchaw ..... H01R 12/88 439/188
4,720,156 A * 1/1988 Beers ..... H01R 12/88 439/260
4,726,775 A * 2/1988 Owen ..... H01R 29/00 439/188
5,144,217 A * 9/1992 Gardner ..... H01M 2/1055 320/110
5,312,262 A * 5/1994 Bublitz ..... H01R 13/633 439/160
5,334,025 A * 8/1994 Fohl ..... B60R 21/017 200/51.1
6,824,410 B1 * 11/2004 Co ..... H01R 12/88 324/750.25
6,855,009 B2 * 2/2005 Nishiyama ..... H01R 12/721 439/325
8,616,907 B2 * 12/2013 Kim ..... H01R 12/87 439/160

* cited by examiner

*Primary Examiner* — Tulsidas C Patel
*Assistant Examiner* — Travis Chambers
(74) *Attorney, Agent, or Firm* — Jeffrey L. Streets

(57) ABSTRACT

An edge connector socket is configured to receive an edge connector on a memory module. A wedge member is slidably secured within the edge connector socket in alignment between contacts on the edge connector and pins within the edge connector socket. A cam is rotatably secured adjacent the wedge member, and an actuator is coupled to the cam. Rotation of the cam moves the wedge member between a first position and a second position. In the first position, the wedge member is disposed between the contacts and the pins and prevents engagement between the contacts and the pins. In the second position, the wedge member is withdrawn from between the contacts and the pins and allows reengagement between the contacts and the pins. Optionally, such a "reseat" action is performed in response to detecting an error associated with the memory module.

20 Claims, 7 Drawing Sheets

CONNECTOR MODULE WITH A RESEAT ACTUATOR

BACKGROUND

Field of the Invention

The present invention relates to the design and use of connectors that connect one printed circuit board to another printed circuit board.

Background of the Related Art

Many servers and other computers include a large number of pluggable modules, such as memory modules, PCIe cards or other expansion cards. For example, the LENOVO x3950 X6 server consumes 8U of rack space and may include up to 192 pluggable memory DIMMs (dual in-line memory modules). Each DIMM or other type of module in a server or other computer must be precisely positioned and there are many contacts that must be made.

The first troubleshooting action when a server reports a DIMM failure is to reseat the DIMM. In many cases, a DIMM failure may be due to dust on the contacts, an improperly positioned contact, or a spring contact that is applying less than the required pressure. Reseating the module will often resolve the failure. Although the solution is simple, reseating the module may require that a service technician physically visit the customer site in order to locate and dis-assemble the server. This process results in significant service cost and server down time for repair.

BRIEF SUMMARY

One embodiment of the present invention provides a system comprising an edge connector socket secured to a first printed circuit board and configured for receiving an edge connector formed on a second printed circuit board. The system further comprises a wedge member slidably secured within the edge connector socket, wherein the wedge member is aligned with an interface between contacts on the edge connector and pins within the edge connector socket. The system still further comprises a cam rotatably secured adjacent the wedge member, and an actuator having a rotatable shaft coupled to the cam. Rotation of the cam moves the wedge member between a first position and a second position, wherein, in the first position, the wedge member is disposed between the contacts and the pins and prevents engagement between the contacts and the pins, and wherein, in the second position, the wedge member is withdrawn from between the contacts and the pins and allows engagement between the contacts and the pins.

In a further embodiment, a system comprises a first connector secured to a first printed circuit board and configured for receiving a second connector, wherein the first connector includes a plurality of first flexible pins and the second connector includes a plurality of second flexible pins aligned to contact the plurality of first flexible pins. The system further comprises a wedge member slidably secured within the first connector, wherein the wedge member is aligned with an interface between the first flexible pins in the first connector and the second flexible pins in the second connector, and a cam rotatably secured adjacent the wedge member. In addition, the system comprises an actuator having a rotatable shaft coupled to the cam, wherein rotation of the cam moves the wedge member between a first position and a second position, wherein, in the first position, the wedge member is disposed between the first flexible pins and the second flexible pins and prevents engagement between the first flexible pins and the second flexible pins, and wherein, in the second position, the wedge member is withdrawn from between the first flexible pins and the second flexible pins and allows engagement between the first flexible pins and the second flexible pins.

Another embodiment of the present invention provides a method comprising detecting an error associated with a module formed on a second printed circuit board having an edge connector seated within an edge connector socket secured to a first printed circuit board. The method further comprises inserting a wedge member between contacts on the edge connector and pins in the edge connector socket in response to detecting the error, wherein the wedge member biases the pins out of engagement with the contacts and wipes an engagement surface of the contacts and an engagement surface of the pins without unseating the edge connector from the edge connector socket, and withdrawing the wedge member from between the contacts and the pins to restore engagement between the contacts and the pins.

DETAILED DESCRIPTION

Figure 1A:
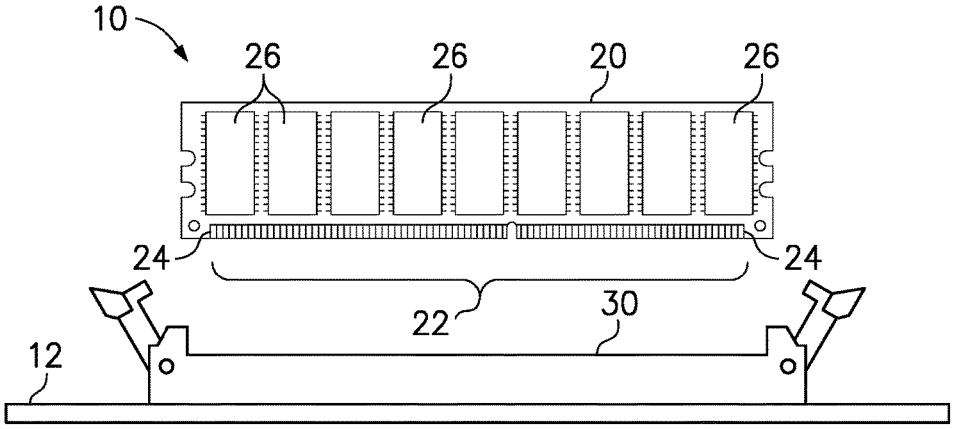
FIG. 1A (PRIOR ART)
FIGS. 1A-1C are diagrams of a memory module being seated and secured in an edge connector socket on a printed circuit board.

One embodiment of the present invention provides a system comprising an edge connector socket secured to a first printed circuit board and configured for receiving an edge connector formed on a second printed circuit board. The system further comprises a wedge member slidably secured within the edge connector socket, wherein the wedge member is aligned with an interface between contacts on the edge connector and pins within the edge connector socket. The system still further comprises a cam rotatably secured adjacent the wedge member, and an actuator having a rotatable shaft coupled to the cam. Rotation of the cam moves the wedge member between a first position and a second position, wherein, in the first position, the wedge member is disposed between the contacts and the pins and prevents engagement between the contacts and the pins, and wherein, in the second position, the wedge member is withdrawn from between the contacts and the pins and allows engagement between the contacts and the pins.

An edge connector socket is a mechanical structure that is permanently secured to a first printed circuit board, such as a motherboard, and is adapted to receive one edge of a second printed circuit board, such as a memory module, expansion module or other daughter card. The edge connector socket has an elongate central opening that physically receives the edge of the second printed circuit board and may include first and second latches that secure the second printed circuit board in a seated position within the edge connector socket. The second printed circuit board has an edge connector including numerous contacts or pads on one or both faces of the second printed circuit board. When the second printed circuit board is in the seated position, the numerous contacts are each aligned for engagement with an opposing pin within the edge connector socket. The engagement between the contacts and the pins provides electronic communication between components on the first and second printed circuit boards. For example, the first printed circuit board may include a processor or memory controller and the second printed circuit board may be a dual in-line memory module (DIMM). Those having ordinary skill in the art will have knowledge of various standard pinouts that may be used to determine the number, spacing and alignment of the contacts on an edge connector and the corresponding pins within an edge connector socket. The present invention is not limited to any one pinout, size, configuration, model or style of edge connector or edge connector socket.

The wedge member and the cam are preferably disposed within a body or housing of the edge connector socket. Most preferably, the wedge member and the cam are disposed at an elevation between the first printed circuit board and an opening of the edge connector socket where the second printed circuit board may be received and seated. Furthermore, the wedge member and the cam may be disposed laterally between a first set of the pins on a first side of the edge connector socket and a second set of the pins on a second side of the edge connector socket. Optionally, the wedge member is slidably secured in a slot formed in each end of the elongate edge connector socket body, so that the wedge is restrained to move parallel to the second printed circuit board, and is preferably also restrained to move over a limited distance.

The wedge member may be aligned with an interface that is formed between contacts on the edge connector and pins within the edge connector socket. This interface is generally immediately along the engagement surface of the contacts on the edge connector. Movement of the wedge member from the second position to the first position, by rotation of the cam, pushes the pins away from the second printed circuit board. Optionally, the wedge member may include a flexible portion or edge, such that the pins push the flexible portion against the contacts. Beneficially, movement of the wedge member from the second position to the first position wipes an engagement surface of the contacts and wipes an engagement surface of the pins. The engagement surfaces of the contacts and the pins may also be wiped as the wedge member is moved in the opposite direction from the first position to the second position.

While a wedge member may be aligned with one interface between the contact and the pins, a preferred wedge member may have a first wedge element aligned with a first interface between the contacts and the pins, and a second wedge element aligned with a second interface between the contacts and the pins, wherein the first interface and the second interface are on opposing sides of the second printed circuit board. A wedge member with first and second wedge elements may be used to simultaneously wipe the engagement surfaces of the contacts and the pins on both sides of the second printed circuit board. The edge connector socket may further include first and second latches for securing the second printed circuit board in a seated position within the edge connector socket while movement of the wedge member from the second position to the first position wipes the engagement surface of the contacts and wipes the engagement surface of the pins.

The cam is rotatably secured adjacent the wedge member. For example, the cam may have a round shaft at each end that extends into a hole in the body of the edge connector socket. Accordingly, the hole in the body may serve as a bearing in which the shaft and the cam may rotate. The shaft may be the same rotatable shaft that is turned by the actuator, or the shaft may be rotatably coupled to the actuator by one or more gears or belts. The cam preferably rotates about an axis that extends parallel to the edge connector socket. Still further, a spring element may be used to bias the wedge member into engagement with the cam as the cam rotates, such that the wedge member may be considered to be a "follower".

The purpose of the cam is to controllably move the wedge member between the first and second positions described herein. Rotation of the cam results in linear movement of the wedge member. The cam may have a cross-sectional profile that is an oval with only one axis of symmetry. Furthermore, embodiments of the present invention may rotate the cam less than a full rotation, such as between 75 and 115 degrees but preferably about 90 degrees, before reversing the rotation, such that the cam may be similar to a straight or curved lever arm. In order to push evenly against the wedge member, the cam should engage the wedge member in at least two places, but the cam may also extend along more than half the length of the edge connector socket.

The actuator applies a rotational force to the shaft and ultimately to the cam. The actuator may include an electrical motor of various types, such as a stepper motor. The actuator may be rotated between a first rotational position and a second rotational position that is offset by an angle between 75 and 115 degrees. Optionally, the electrical actuator is operated under the control of a processor, such as a baseboard management controller, that is installed on the first printed circuit board. Accordingly, the processor may execute a program and initiate the described movement of the wedge member (i.e., a "reseat action"), preferably in response to detecting an error associated with the second printed circuit board or a module that includes the second printed circuit board.

Further embodiments of the system include a second edge connector socket, similar to the edge connector socket described above, having a cam that is coupled to the same actuator. For example, the "reseat action" may be simultaneously performed in multiple edge connector sockets. In one non-limiting configuration, the system includes a second edge connector socket secured to the first printed circuit board and configured for receiving an edge connector of a third printed circuit board, a second wedge member slidably secured within the second edge connector socket, wherein the second wedge member is aligned with an interface between contacts of the edge connector of the third printed circuit board and pins within the second edge connector socket, and a second cam rotatable secured adjacent the second wedge member, wherein the second cam is rotatable coupled to the first cam. Preferably, the first and second edge connector sockets are axially aligned.

In a further embodiment, a system comprises a first connector secured to a first printed circuit board and configured for receiving a second connector, wherein the first connector includes a plurality of first flexible pins and the second connector includes a plurality of second flexible pins aligned to contact the plurality of first flexible pins. The system further comprises a wedge member slidably secured within the first connector, wherein the wedge member is aligned with an interface between the first flexible pins in the first connector and the second flexible pins in the second connector, and a cam rotatably secured adjacent the wedge member. In addition, the system comprises an actuator having a rotatable shaft coupled to the cam, wherein rotation of the cam moves the wedge member between a first position and a second position, wherein, in the first position, the wedge member is disposed between the first flexible pins and the second flexible pins and prevents engagement between the first flexible pins and the second flexible pins, and wherein, in the second position, the wedge member is withdrawn from between the first flexible pins and the second flexible pins and allows engagement between the first flexible pins and the second flexible pins.

The foregoing system may be used in a method comprising detecting an error associated with a component coupled to the second connector that has been connected to the first connector secured to a printed circuit board. A wedge member is inserted between the flexible pins of the second connector and the flexible pins of the first connector in response to detecting the error, wherein the wedge member biases the flexible pins of the second connector out of engagement with the flexible pins of the first connector and wipes an engagement surface of the flexible pins without unseating the second connector from the first connector. The wedge member is then withdrawn from between the flexible pins to restore engagement between the flexible pins of the second connector and the flexible pins of the first connector.

Another embodiment of the present invention provides a method comprising detecting an error associated with a module formed on a second printed circuit board having an edge connector seated within an edge connector socket secured to a first printed circuit board. The method further comprises inserting a wedge member between contacts on the edge connector and pins in the edge connector socket in response to detecting the error, wherein the wedge member biases the pins out of engagement with the contacts and wipes an engagement surface of the contacts and an engagement surface of the pins without unseating the edge connector from the edge connector socket, and withdrawing the wedge member from between the contacts and the pins to restore engagement between the contacts and the pins. In one option, the step of inserting the wedge member between contacts on the edge connector and pins in the edge connector socket includes rotating a cam engaging the wedge member. In another option, the steps of inserting and withdrawing of the wedge member may be repeated in order to perform a greater extent of wiping the contacts and pins and additional flexing of the pins.

In a further embodiment, an error associated with second printed circuit board may be reported to a management entity, such that the management entity may halt use of the module prior to sliding the wedge member between the contacts and the pins, and then restore use of the module after withdrawing the wedge member. Optionally, the first and second printed circuit boards are components of a server, wherein the error is reported to a server management application, and wherein the server management application initiates the inserting and withdrawing of the wedge member in response to receiving the module error.

Embodiments of the present invention provide a connector that allows the mating contacts of the connector to be moved and flexed to emulate a reseat action. Mating electrical contact surfaces may be wiped and the flexible spring nature of the pins may be exercised without removing the printed circuit board from the edge connector socket. Accordingly, the contacts and the pins experience wiping and flexing actions that are similar to what occurs when the printed circuit board, such as a memory DIMM, is removed and replaced in a standard edge connector socket.

In a still further embodiment, a computer program product comprises a non-transitory computer readable storage medium having program instructions embodied therewith, where the program instructions are executable by a processor to cause the processor to perform a method. As described above, that method may comprise detecting an error associated with a module formed on a second printed circuit board having an edge connector seated within an edge connector socket secured to a first printed circuit board. The method may further comprise inserting a wedge member between contacts on the edge connector and pins in the edge connector socket in response to detecting the error, wherein the wedge member biases the pins out of engagement with the contacts and wipes an engagement surface of the contacts and an engagement surface of the pins without unseating the edge connector from the edge connector socket, and withdrawing the wedge member from between the contacts and the pins to restore engagement between the contacts and the pins.

The foregoing computer program products may further include program instructions for implementing or initiating any one or more aspects of the methods described herein. Accordingly, a separate description of the methods will not be duplicated in the context of a computer program product.

Figure 1B:
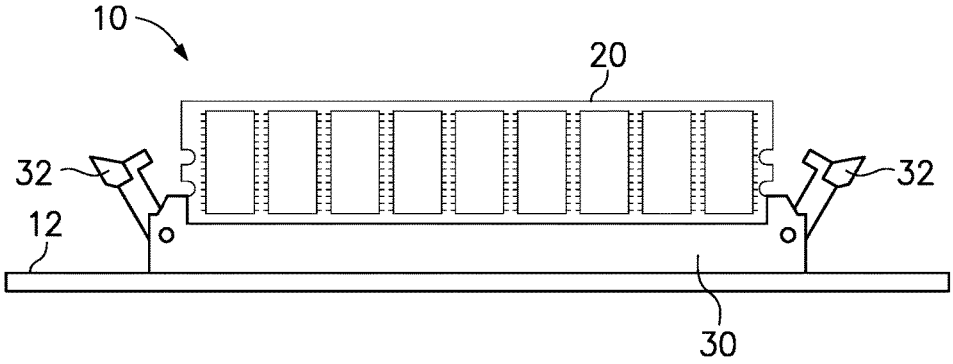
FIG. 1B (PRIOR ART)
Figure 1C:
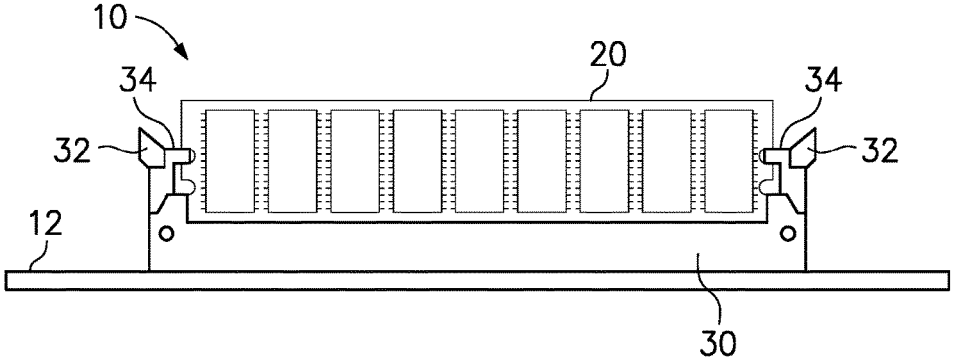
FIG. 1C (PRIOR ART)

FIGS. 1A-1C are diagrams of a system 10 including a memory module 20 being seated and secured in an edge connector socket 30 secured on a printed circuit board 12. In FIG. 1A, the memory module 20 is disconnected from, but aligned with, the edge connector socket 30. Note that the memory module 20 includes an edge connector 22 including a plurality of contacts 24 that facilitate electronic communication with the dynamic random-access memory (DRAM) chips 26. Notches 28 are provided along the side edges of the memory module 20 to facilitate latching of the memory module 20 to the edge connector socket 30. In FIG. 1B, the memory module 20 has been received and seated in the edge connector socket 30, but the two latches 32 are still open such that the memory module 20 is not secured. In FIG. 1C, the two latches 32 have been closed such that each latch arm 34 enters one of the notches 28 on each side edge of the memory module 20. In the latched condition of FIG. 1C, the memory module 20 is secured in a seated position unless the latches 32 are intentionally manually opened.

Figure 2:
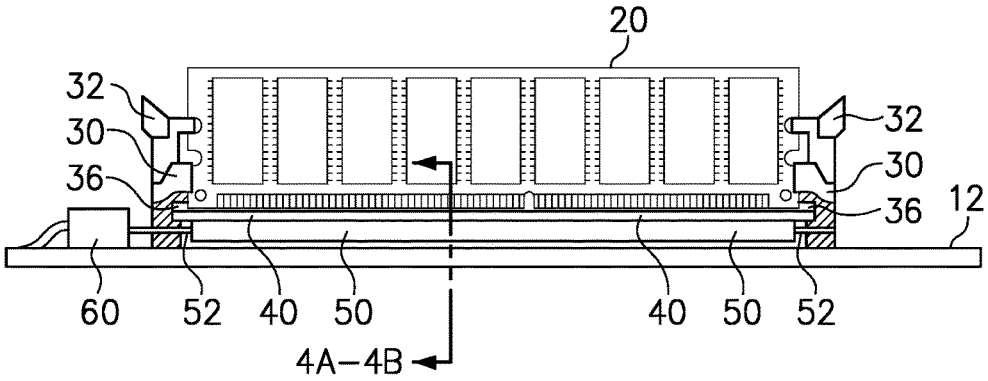
FIG. 2 is a partial cross-sectional side view of an edge connector socket according to one embodiment of the present invention.

FIG. 2 is a partial cross-sectional side view of the edge connector socket 30 according to one embodiment of the present invention. A proximal side of the body of the edge connector socket 30 has been removed from this illustration for the purpose of showing a wedge member 40 and a cam 50, which both extend substantially the length (left to right in FIG. 2) of the edge connector socket 30. The wedge member 40 has opposing ends 42 that are slidably received in a track or guide 36 in the ends of the edge connector socket 30. The guide 36 preferably restricts the wedge member 40 to translational movement (up and down in FIG. 2). The cam 50 has a shaft 52 extending from each end and received through a hole in the body of the edge connector socket 30, which serves as a bearing in which the shaft 52 may rotate. An actuator 60 is coupled to the shaft 52 to controllably rotate the shaft 52 and the cam 50 about an axis defined by the shaft 52.

Figure 3:
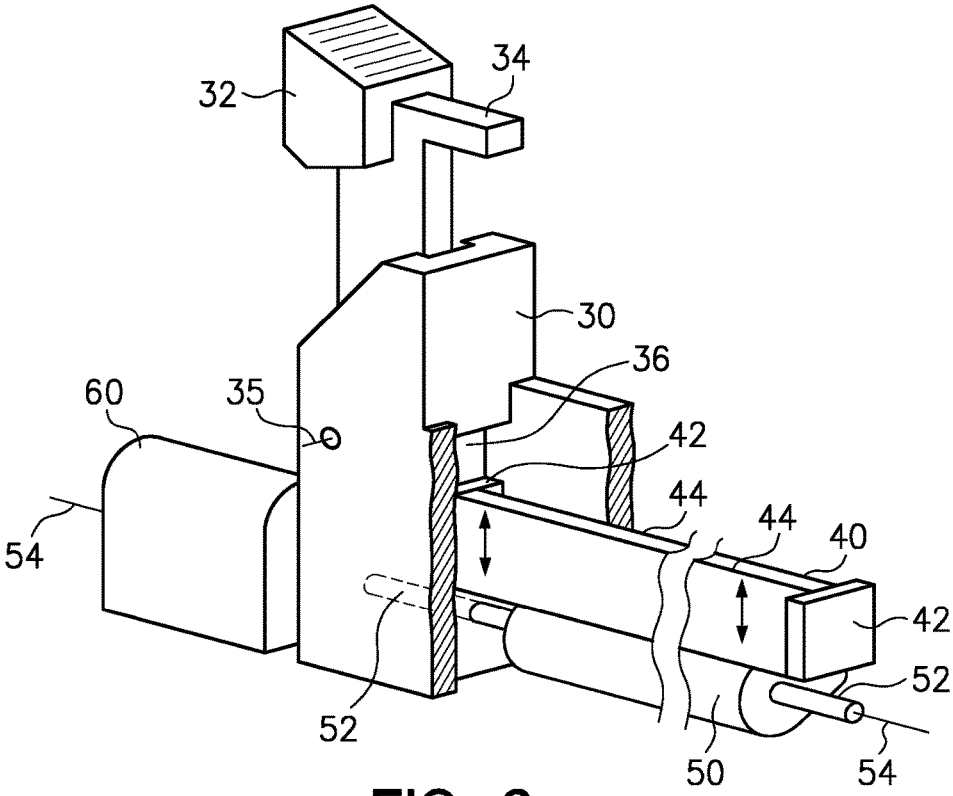
FIG. 3 is a schematic perspective view of one end of the edge connector socket.

FIG. 3 is a schematic perspective view of one end of the edge connector socket 30. A latch 32 is shown pivotally coupled to the socket body 30 about an axis 35. The socket body 30 also include a guide 36 for receiving an end 42 of the wedge member 40. In the embodiment shown, the wedge member 40 has two spaced-apart wedge elements 44 that extend between the two ends 42. While other track or guide configurations are within the scope of the invention, the rectangular guides 36 (only one shown in FIG. 3) slidably receive the rectangular ends 42 and maintain the orientation of the wedge member 40 so that the wedge elements 44 are kept in a proper alignment, as is discussed in reference to FIGS. 4A-4B.

The cam 50 is disposed adjacent the wedge member 40 and is rotatable about an axis 54 defined by the shafts 52. The actuator 60 is positioned to one end of the edge connector socket 30 and is coupled to controllably rotate the shaft 52 and the cam 50. A hole through the body of the socket 30 serves as a bearing to allow rotation. The wedge member 40 is preferably maintain in contact with the cam 50 throughout the rotation of the cam 50, such as using a spring (not shown) to push or pull the wedge member against the cam 50 (downward in FIG. 3).

Figure 4A:
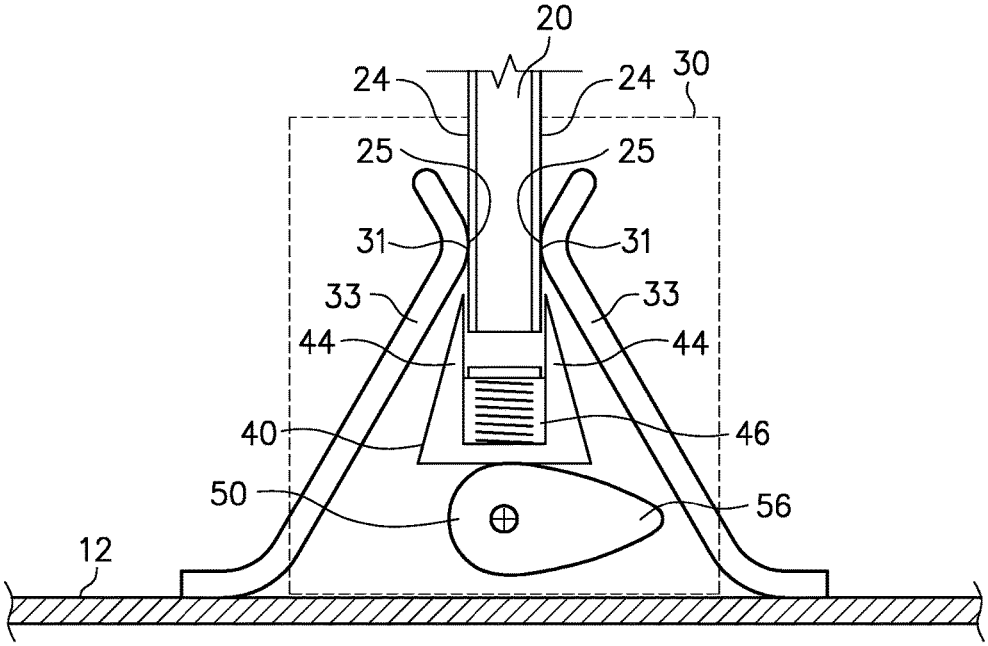
FIGS. 4A-4B are schematic end views of the edge connector socket with a cam and wedge member in a withdrawn position and an inserted position, respectively.
Figure 4B:
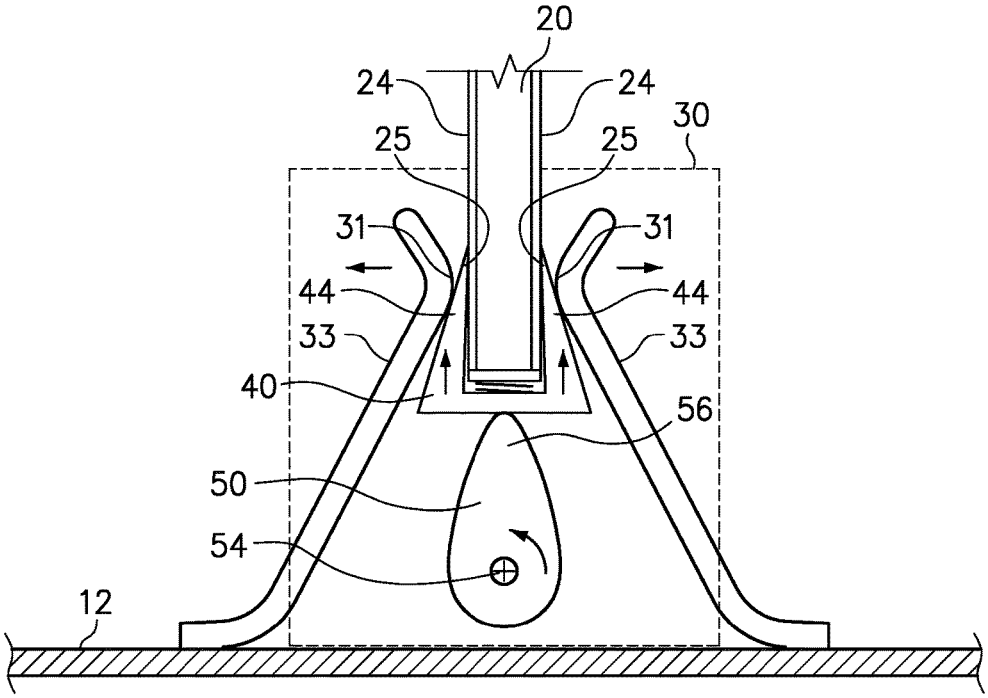

FIGS. 4A-4B are schematic cross-sectional views of the edge connector socket 30 with a cam 50 and wedge member 40 in a withdrawn position and an inserted position, respectively. The cross-section used in both Figures is taken at a point in the middle of the edge connector socket 30, as marked in FIG. 2. Moving the wedge member 40 from the withdrawn position (FIG. 4A) to the inserted position (FIG. 4B) and back to the withdrawn position (FIG. 4A) may be referred to as a "reseat" action.

In FIG. 4A, the edge connector socket 30 has received and latched the memory module 20 into a seated position. In this operative position, the electronically conductive contacts 24 formed on the memory module 20 are engaged with electronically conductive pins 33 within the edge connector socket 30 to complete a communication path from the memory module 20 (see DRAM 26 in FIG. 1C) to one or more components on the printed circuit board 12. The pins 33 may be flexible or otherwise spring biased and positioned to press against the contacts 24 so that during normal use there is continuous contact between an engagement surface 31 of the pins 33 and an engagement surface 25 of the contacts 24.

The cam 50 is in a rotational position or angle with an enlarged end 56 extending laterally to one side. Accordingly, the wedge member 40 is in a lower or withdrawn position (second position) where neither of the two wedge elements 44 are affecting the normal use or operation of the edge connector socket 30. However, the wedge member 40 is aligned with an interface between the contacts 24 and pins 33. In this embodiment, the wedge member 40 includes two wedge elements 44, where a first wedge element 44 is aligned with a first interface between the contacts and the pins on a first side of the memory module 20, and where a second wedge element 44 is aligned with a second interface between the contacts and the pins on a second side of the memory module 20. Still further, a spring element 46 is disposed between the two wedge elements 44 for use as described below in reference to FIG. 4B.

In FIG. 4B, the cam 50 has been rotated about the axis 54 (about 90 degrees counter-clockwise in FIG. 4B) such that the enlarged end 56 is now extending toward the wedge member 40. Accordingly, the wedge member 40 has moved around the end of the memory module 20 where the contacts 24 of the edge connector are formed. As the wedge member 40 moves from the lower (second) position (shown in FIG. 4A) to the upper (first) position (shown in FIG. 4B), the spring element 46 is compressed against the end of the memory module 20, the wedge elements 44 wipe against the contacts 24 and the pins 33, and the pins 33 are flexed or exercised outwardly away from contacts 24. In the process, the engagement surface 31 of the pins 33 and the engagement surface 25 of the contacts 24 are wiped free of dust or particles that may be interfering with a good electronic connection therebetween. Optionally, the wedge elements 44 may be flexible, such as a thin plastic, rubber or metal member, such that the pins 33 bias the wedge elements 44 into contact with the contacts 24. For example, the wedge elements 44 may be squeezed between the contacts 24 and the pins 33. It should be recognized that the wedge elements 44 may have various profiles other than a continuous flat slope as necessary or desired to effectively wipe both the engagement surface 25 of the contacts 24 and the engagement surface 31 of the pins 33. Furthermore, since the pins 33 are flexible or spring biased, the wedge elements 44 may have a rounded or blunt end and will still be able to move between the contacts and the pins. The pointed wedge elements are shown for the purpose of illustration and should be limiting of the shape of the wedge elements.

In order to complete the "reseat" action and restore electronic communication between the memory module 20 and the printed circuit board 12, the cam 50 is then rotated back to the lateral position shown in FIG. 4A. As the enlarged end 56 of the cam moves, the wedge member 40 is allowed to gradually move away from the end of the memory module 20 assisted by gravity and by the spring element 46. A beneficial wiping action may occur as the wedge member 40 moves in either direction. Once the wedge elements have withdrawn from between the contacts and the pins, the engagement surface 25 of the contacts 24 and the engagement surface 31 of the pins 33 are again in contact and communication between the memory module 20 and other components on the printed circuit board 12 may be restored. Notice that throughout the "reseat action" the memory module 20 has not moved and remains seated and secured within the edge connector socket 30. Accordingly, the "reseat action" may be performed by actuation of the cam 50 without any manual access or manipulation of the memory module.

Figure 5:
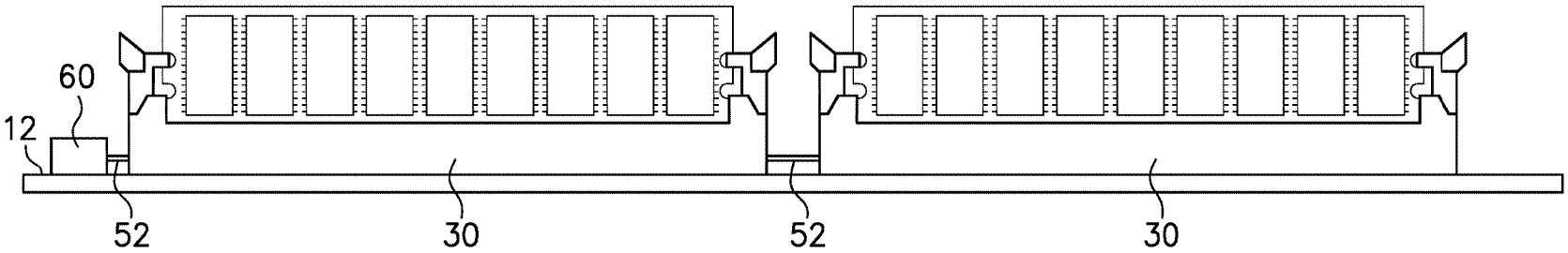
FIG. 5 is a side view of two axially aligned edge connector sockets having cams that are interconnected and operated by a single actuator.

FIG. 5 is a side view of two axially aligned edge connector sockets 30, secured on a common printed circuit board 12, having cams (see cam 50 in FIG. 2) that are interconnected and operated by a single actuator 60. The shaft 52 shown in FIG. 2 is extended between the two edge connector sockets 30 so that the "reseat" action is performed on both memory modules 20 at the same time. Other types of linkages and mechanisms can be envisioned to use a single actuator to drive a "reseat" action on axially aligned or side-by-side edge connector sockets.

Figure 6:
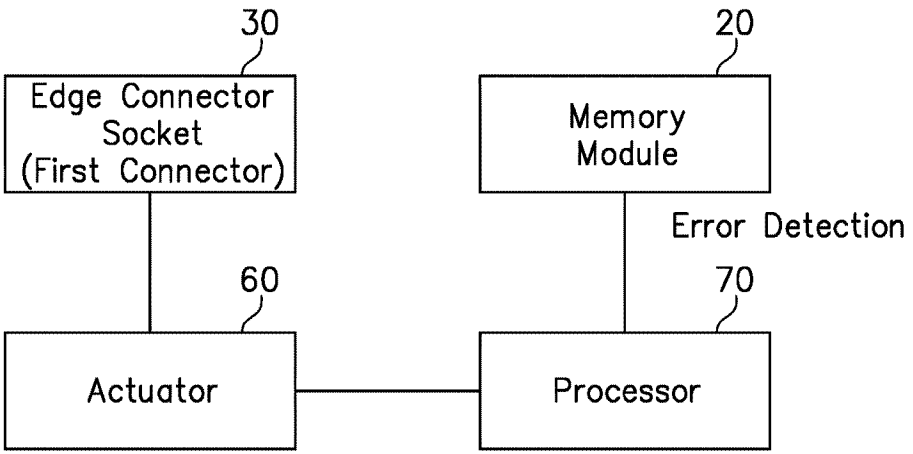
FIG. 6 is a system diagram consistent with various embodiments of the present invention.

FIG. 6 is a system diagram consistent with various embodiments of the present invention. The system includes a memory module 20 in communication with a processor 70. When the processor 70 detects an error associated with the memory module 20, the processor 70 causes the actuator 60 to impart a "reseat" action on the edge connector socket 30. After the "reseat" action, the processor 70 may determine whether or not the memory module 20 is still experiencing an error. The "reseat" action may be repeated. In a network environment, a remote management module or application may instruct the processor to initiate the "reseat" action. Optionally, the processor may be either a central processing unit (CPU) or a baseboard management controller (BMC).

Figure 7A:
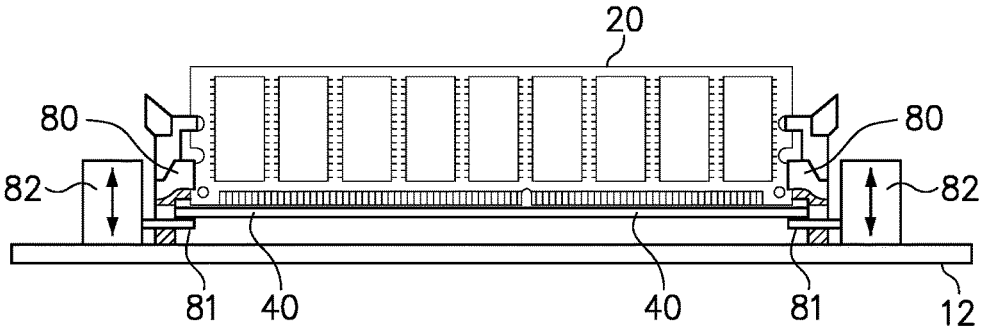
FIG. 7A is a partial cross-sectional side view of an edge connector socket according to a second embodiment of the present invention.

FIG. 7A is a partial cross-sectional side view of an edge connector socket 80 according to a second embodiment of the present invention. A proximal side of the body of the edge connector socket 80 has been removed from this illustration for the purpose of showing the wedge member 40 and a lift pin 81 of an actuator mechanism 82. A similar actuator mechanism 82 is located at each end of the edge connector socket 80. Simultaneous activation of the two actuator mechanisms 82 will raise and lower the wedge member 40.

Figure 7B:
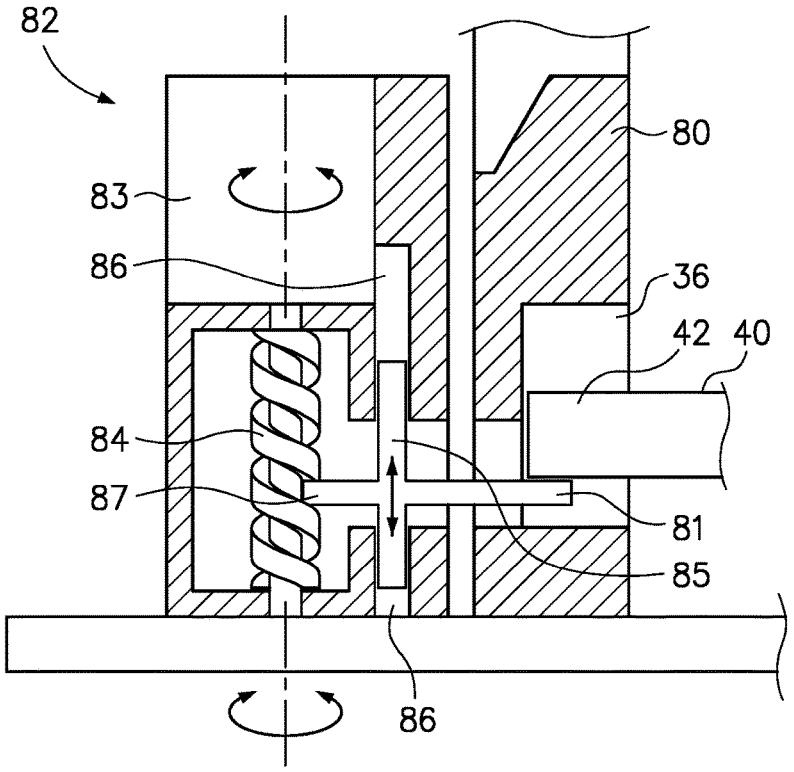
FIG. 7B is a schematic cross-sectional side view of an actuator mechanism according to the second embodiment of the present invention.

FIG. 7B is a schematic cross-sectional side view of an actuator mechanism 82 according to the second embodiment of the present invention. The actuator mechanism 82 includes a motor 83 that turns a worm 84 (i.e., a shaft with an angled groove). The lift pin 81 is attached to a plate 85 that slides within a slot 86 so that the lift pin 81 and an opposing drive pin 87 are limited to translational upward and downward movement (see two-directional arrow). The wedge member 40 has an end 42 that is slidably received in a track or guide 36 formed in the ends of the edge connector socket 80. The guide 36 preferably restricts the wedge member 40 to translational movement (up and down in FIG. 7B). Preferably, the lift pin 81 may be permanently coupled to the wedge member 40, such that the wedge member may be moved up and then back down by reversing the rotational direction of the motor 83, which negates the need for a spring.

Figure 8C:
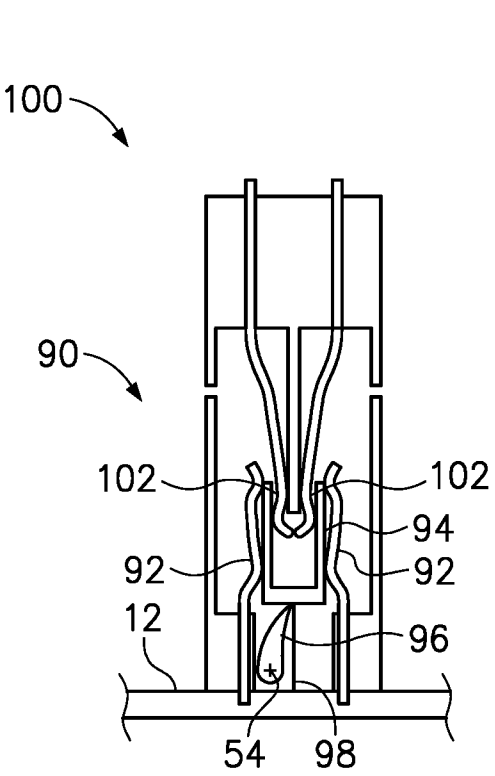
FIGS. 8A-8C are schematic end views of a pin-wipe style connector with a cam and wedge member, where opposing connectors are aligned, where the connectors are fully connected, and wherein connected connectors are in a reseat condition, respectively.
Figure 8B:
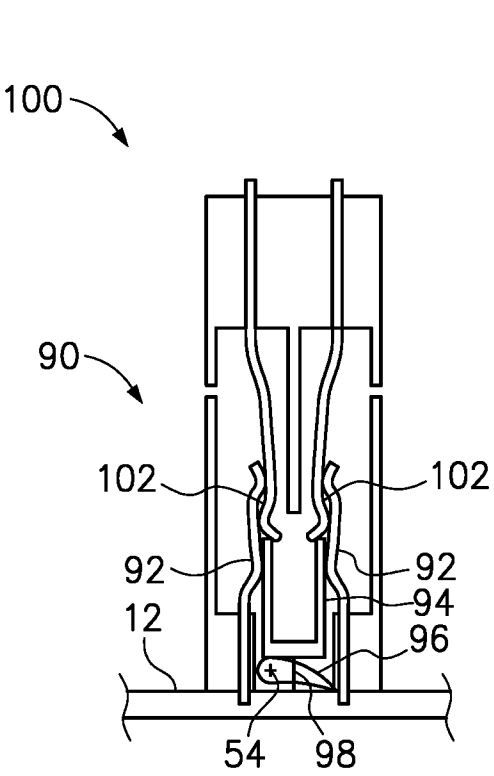
Figure 8A:
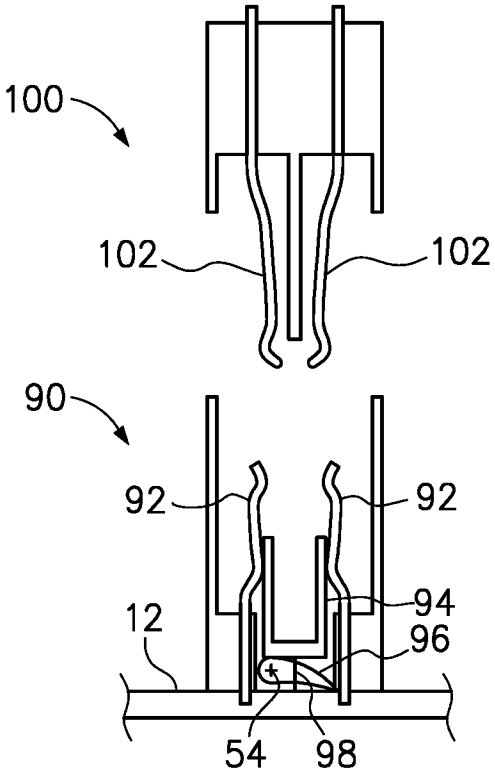

FIGS. 8A-8C are schematic end views of a pin-wipe style connector with a cam and wedge member, where opposing connectors are aligned, where the connectors are fully connected, and wherein connected connectors are in a reseat condition, respectively. In FIG. 8A, a first connector 90 is secured to a printed circuit board 12. The first connector 90 includes one or more pairs of flexible pins or contacts 92 that are electronically conductive and in communication with other conductive elements, such as lines and traces (not shown), on the circuit board 12. As with the edge connector socket 30 of FIGS. 2, 3, and 4A-4B, The first connector 90 includes a wedge member 94 and a cam 96 having a shaft extending from each end and received through a hole in the body of the first connector 90, which serves as a bearing in which the shaft 52 may rotate. An actuator 60 (see FIGS. 2 and 3) is coupled to the shaft to controllably rotate the shaft and the cam 96 about an axis 54 defined by the shaft. As with the actuator 60 (see FIGS. 2 and 3), the wedge 94 is preferably limited to up and down movement and is preferably kept in contact with the cam 96, such as with a spring element. A spring element is shown as an elastic element 98 having one end secured to the bottom of the wedge 94 and a second end secured to a lower portion of the first connector 90. A second connector 100 includes one or more pairs of flexible pins or contacts 102 that are electronically conductive and in communication with other conductive elements, such as a cable or pluggable component (not shown). The housings of the first connector 90 and the second connector 100 are shown for purposes of illustration, but should not be taken as limiting the configuration of the connectors. Optionally, the housings may serve to facilitate coupling to components such as the printed circuit board 12, maintain alignment of the flexible pins or contacts 92, 102 as they are connected, and prevent mechanical stress from affected the connections during use.

In FIG. 8B, the second connector 100 has been moved toward the first connector 90 such that the flexible pins 102 of the second connector 100 engage and slide between the flexible pins 92 of the first connector 90. The spacing and configuration of the flexible pins 92, 102 require that the flexible pins 102 of the second connector 100 flex inwardly while the flexible pins 92 of the first connector 90 flex outwardly. Accordingly, the flexible pins 92, 102 wipe against each other from a point of first contact until reaching the operable position shown.

In FIG. 8C, the cam 96 has been rotated (counter-clockwise in this view) by the actuator (see actuator 60 of FIGS. 2 and 3) to overcome the spring force in the elastic element 98 and push the left and right wedge elements of the wedge 94 upward between the opposing connections between the flexible pins 92, 102. As shown, the flexible pins 102 of the second connector 100 flex inwardly and the flexible pins 92 of the first connector 90 flex outwardly as the wedge elements of the wedge 94 wipe the contact surfaces of the flexible pins 92, 102. In order to complete a reseat action, the cam 96 is rotated (clockwise in this view) and the wedge 94 is pulled downward by the elastic element 98 such that the cam 96, wedge 94 and flexible pins 92, 102 return to the positions shown in FIG. 8B. Accordingly, the reseat action can be performed without manually disconnecting the first and second connectors 90, 100.

Figure 9:
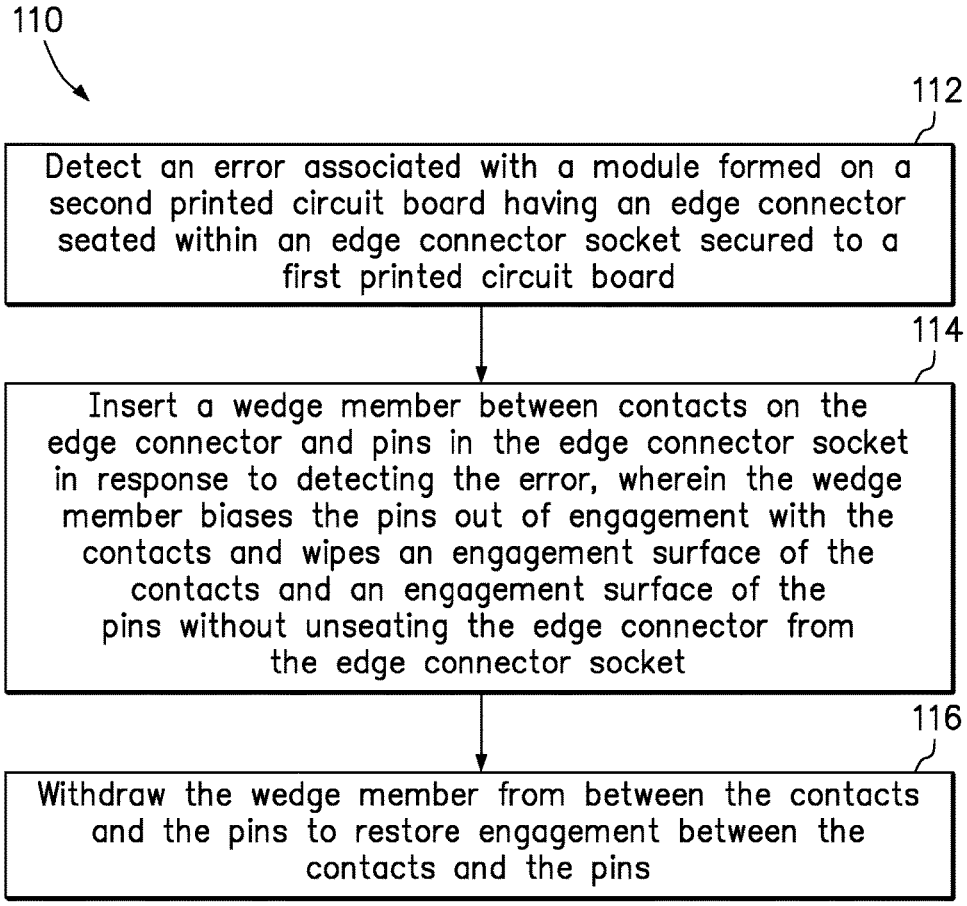
FIG. 9 is a flowchart of a method according to one embodiment of the present invention.

FIG. 9 is a flowchart of a method 110 according to one embodiment of the present invention. In step 112, the method detect an error associated with a module formed on a second printed circuit board having an edge connector seated within an edge connector socket secured to a first printed circuit board. In step 114, the method inserts a wedge member between contacts on the edge connector and pins in the edge connector socket in response to detecting the error, wherein the wedge member biases the pins out of engagement with the contacts and wipes an engagement surface of the contacts and an engagement surface of the pins without unseating the edge connector from the edge connector socket. In step 116, the method withdraws the wedge member from between the contacts and the pins to restore engagement between the contacts and the pins.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention may be described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, and/or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A system, comprising:

an edge connector socket secured to a first printed circuit board and configured for receiving an edge connector formed on a second printed circuit board;

a wedge member slidably secured within the edge connector socket, wherein the wedge member is aligned with an interface between contacts on the edge connector and pins within the edge connector socket;

a cam rotatably secured adjacent the wedge member; and an actuator having a rotatable shaft coupled to the cam, wherein rotation of the cam moves the wedge member between a first position and a second position, wherein, in the first position, the wedge member is disposed between the contacts and the pins and prevents engagement between the contacts and the pins, and wherein, in the second position, the wedge member is withdrawn from between the contacts and the pins and allows engagement between the contacts and the pins.

2. The system of claim 1, wherein movement of the wedge member from the second position to the first position pushes the pins away from the second printed circuit board.

3. The system of claim 1, wherein the cam is rotatable between a first rotational position and a second rotational position that is offset by an angle between 75 and 115 degrees.

4. The system of claim 1, further comprising:

a spring element biasing the wedge member into engagement with the cam.

5. The system of claim 1, wherein the second printed circuit board is a memory module.

6. The system of claim 1, wherein movement of the wedge member from the second position to the first position wipes an engagement surface of the contacts and wipes an engagement surface of the pins.

7. The system of claim 6, further comprising:

first and second latches for securing the second printed circuit board in a seated position within the edge connector socket while movement of the wedge member from the second position to the first position wipes the engagement surface of the contacts and wipes the engagement surface of the pins.

8. The system of claim 1, wherein the wedge member has a first wedge element aligned with a first interface between the contacts and the pins, wherein the wedge member has a second wedge element aligned with a second interface between the contacts and the pins, and wherein the first interface and the second interface are on opposing sides of the second printed circuit board.

9. The system of claim 8, wherein each the first and second wedge elements include a flexible edge.

10. The system of claim 1, further comprising:

a processor on the first printed circuit board controlling the actuator.

11. The system of claim 10, wherein the processor is a baseboard management controller.

12. The system of claim 1, wherein the cam is rotatable about an axis that extends parallel to the edge connector socket.

13. The system of claim 12, wherein the cam extends along more than half the length of the edge connector socket.

14. The system of claim 1, further comprising:

a second edge connector socket secured to the first printed circuit board and configured for receiving an edge connector of a third printed circuit board;

a second wedge member slidably secured within the second edge connector socket, wherein the second wedge member is aligned with an interface between contacts of the edge connector of the third printed circuit board and pins within the second edge connector socket;

a second cam rotatable secured adjacent the second wedge member, wherein the second cam is rotatable coupled to the first cam.

15. The system of claim 14, wherein the first and second edge connector sockets are axially aligned.

16. A method, comprising:

detecting an error associated with a module formed on a second printed circuit board having an edge connector seated within an edge connector socket secured to a first printed circuit board;

inserting a wedge member between contacts on the edge connector and pins in the edge connector socket in response to detecting the error, wherein the wedge member biases the pins out of engagement with the contacts and wipes an engagement surface of the contacts and an engagement surface of the pins without unseating the edge connector from the edge connector socket; and withdrawing the wedge member from between the contacts and the pins to restore engagement between the contacts and the pins.

17. The method of claim 16, further comprising:

reporting the error to a management entity;

halting use of the module prior to sliding the wedge member between the contacts and the pins; and restoring use of the module after withdrawing the wedge member.

18. The method of claim 16, wherein the first and second printed circuit boards are components of a server, wherein the error is reported to a server management application, and wherein the server management application initiates the inserting and withdrawing of the wedge member in response to receiving the module error.

19. The method of claim 16, wherein sliding the wedge member between contacts on the edge connector and pins in the edge connector socket includes rotating a cam engaging the wedge member.

20. A system, comprising:

a first connector secured to a first printed circuit board and configured for receiving a second connector, wherein the first connector includes a plurality of first flexible pins and the second connector includes a plurality of second flexible pins aligned to contact the plurality of first flexible pins;

a wedge member slidably secured within the first connector, wherein the wedge member is aligned with an interface between the first flexible pins in the first connector and the second flexible pins in the second connector;

a cam rotatably secured adjacent the wedge member; and an actuator having a rotatable shaft coupled to the cam, wherein rotation of the cam moves the wedge member between a first position and a second position, wherein, in the first position, the wedge member is disposed between the first flexible pins and the second flexible pins and prevents engagement between the first flexible pins and the second flexible pins, and wherein, in the second position, the wedge member is withdrawn from between the first flexible pins and the second flexible pins and allows engagement between the first flexible pins and the second flexible pins.

* * * * *